US008313589B2

(12) United States Patent
Takasawa et al.

(10) Patent No.: US 8,313,589 B2
(45) Date of Patent: Nov. 20, 2012

(54) HIGH-STRENGTH LOW-ALLOY STEEL EXCELLENT IN HIGH-PRESSURE HYDROGEN ENVIRONMENT EMBRITTLEMENT RESISTANCE CHARACTERISTICS AND METHOD FOR PRODUCING THE SAME

(75) Inventors: Koichi Takasawa, Muroran (JP); Yoru Wada, Muroran (JP); Ryoji Ishigaki, Muroran (JP); Yasuhiko Tanaka, Tokyo (JP)

(73) Assignee: The Japan Steel Works, Ltd., Tokyo (JP)

( * ) Notice: Subject to any disclaimer, the term of this patent is extended or adjusted under 35 U.S.C. 154(b) by 218 days.

(21) Appl. No.: 12/674,228

(22) PCT Filed: Aug. 21, 2008

(86) PCT No.: PCT/JP2008/064885

§ 371 (c)(1),
(2), (4) Date: Apr. 22, 2010

(87) PCT Pub. No.: WO2009/025314

PCT Pub. Date: Feb. 26, 2009

(65) Prior Publication Data

US 2010/0212785 A1 Aug. 26, 2010

(30) Foreign Application Priority Data

Aug. 21, 2007 (JP) ..... 2007-214937

(51) Int. Cl.

| | |
|---|---|
| ***C22C 38/20*** | (2006.01) |
| ***C22C 38/22*** | (2006.01) |
| ***C22C 38/24*** | (2006.01) |
| ***C21D 8/00*** | (2006.01) |
| ***C21D 9/00*** | (2006.01) |

(52) U.S. Cl. ..... 148/330; 148/332; 148/334; 148/547; 148/548; 148/662; 148/663; 148/654

(58) Field of Classification Search ..... 148/320, 148/330, 334, 335, 654, 663, 332, 662, 547, 148/548

See application file for complete search history.

(56) References Cited

U.S. PATENT DOCUMENTS 4,375,377 A * 3/1983 Ohtani et al. ..... 148/661

(Continued)

FOREIGN PATENT DOCUMENTS

JP 63-145748 A 6/1988

(Continued)

OTHER PUBLICATIONS

Machine-English translation of Japanese patent No. 2006-206942, Nagao Akihide et al., Aug. 10, 2006.*

(Continued)

*Primary Examiner* — Deborah Yee
(74) *Attorney, Agent, or Firm* — Sughrue Mion, PLLC

(57) ABSTRACT

An object of the present invention is to provide at a low cost a low-alloy steel having a high strength and excellent high-pressure hydrogen environment embrittlement resistance characteristics under a high-pressure hydrogen environment. The invention is a high-strength low-alloy steel excellent in high-pressure hydrogen environment embrittlement resistance characteristics, which is characterized in that the steel has a composition comprising C: 0.10 to 0.20%, Si: 0.10 to 0.40%, Mn: 0.50 to 1.20%, Cr: 0.20 to 0.80%, Cu: 0.10 to 0.50%, Mo: 0.10 to 1.00%, V: 0.01 to 0.10%, B: 0.0005 to 0.005% and N: 0.01% or less, by mass, with the balance consisting of Fe and unavoidable impurities.

4 Claims, 2 Drawing Sheets

U.S. PATENT DOCUMENTS 8,016,953 B2 * 9/2011 Yamasaki et al. ..... 148/328

FOREIGN PATENT DOCUMENTS

| | | | |
|---|---|---|---|
| JP | 03-267348 | A | 11/1991 |
| JP | 2002-327235 | * | 11/2002 |
| JP | 2005-002386 | A | 1/2005 |
| JP | 2005-097725 | A | 4/2005 |
| JP | 2006-206942 | A | 8/2006 |
| WO | 2004/111291 | A1 | 12/2004 |

OTHER PUBLICATIONS

International Search Report (PCT/ISA/210) dated Nov. 25, 2008 in PCT/JP2008/064885.

International Preliminary Examination Report (PCT/ISA/237) dated Nov. 25, 2008 in PCT/JP2008/064885.

* cited by examiner

HIGH-STRENGTH LOW-ALLOY STEEL EXCELLENT IN HIGH-PRESSURE HYDROGEN ENVIRONMENT EMBRITTLEMENT RESISTANCE CHARACTERISTICS AND METHOD FOR PRODUCING THE SAME

TECHNICAL FIELD

The present invention relates to a high-strength low-alloy steel used for a pressure vessel for storing high-pressure hydrogen and the like, produced by a quenching-tempering treatment (hereinafter referred to as heat treatment), having a tensile strength in the air ranging from 900 to 950 MPa and having excellent high-pressure hydrogen environment embrittlement resistance characteristics, and a method for producing the same.

BACKGROUND ART

In a hydrogen infrastructure constitution business for building a hydrogen society, the spread of hydrogen stations for storing and supplying high-pressure hydrogen is important. In order to constitute the hydrogen stations having high reliability, development of high-pressure hydrogen gas pressure vessels is indispensable, and development of excellent materials for the pressure vessels has been desired. Here, metal materials, particularly steel materials, have promise as the materials for the pressure vessels, from the viewpoints of cost and recyclability.

As a technical trend, it has been desired that the pressure of stored gas is made higher in order to extend a travel distance of hydrogen cars, and it has been envisioned that the high-pressure hydrogen gas of 35 MPa or more is stored in the pressure vessels of the hydrogen stations. However, in carbon steels or high-strength low-alloy steels, it has been considered that hydrogen environment embrittlement occurs under a high-pressure hydrogen gas environment, and a steel material which can be used under a high-pressure hydrogen gas environment of 35 MPa or more has been almost limited to an austenitic stainless steel until now. The austenitic stainless steel is generally more expensive than a ferritic steel, and has a stable austenite phase up to room temperature, so that strength adjustment by heat treatment cannot be performed. Accordingly, as the material for the pressure vessels for storing the higher-pressure hydrogen gas, a high-strength ferritic steel represented by a Cr—Mo steel has been desired.

As a conventional technique, for example, patent literature 1 proposes a carbon steel or a low-alloy steel under a high-pressure hydrogen environment, a seamless steel pipe produced therefrom, and a method for producing the same. In this proposed technique, the Ca/S ratio of constituents is controlled, thereby decreasing the amount of diffusible hydrogen in the steel to improve high-pressure hydrogen environment embrittlement resistance characteristics.

Patent Literature 1: JP-A-2005-2386

DISCLOSURE OF THE INVENTION

Problems that the Invention is to Solve

However, the above-described proposed technique is based on test data obtained by simulating a high-pressure hydrogen environment by an electrolytic hydrogen charge, and only indirectly evaluates hydrogen environment embrittlement resistance characteristics. Further, with regard to mechanical properties indispensable for design or production of actual equipment, particularly mechanical properties in a state affected by hydrogen environment embrittlement, no data is shown. Furthermore, from the results of conventional tensile tests in a hydrogen environment of 45 MPa for various Cr—Mo steels, a high yield strength steel plate for welded construction, JIS G 3128 SHY685NS, shows a large reduction of area in hydrogen, and has been a material excellent in hydrogen environment embrittlement resistance characteristics. However, the tensile strength in the air thereof does not reach 900 to 950 MPa as the present target strength.

The present invention has been made against the background of the present situation of development of high-strength steels excellent in high-pressure hydrogen environment embrittlement resistance characteristics, and the hydrogen environment embrittlement resistance characteristics in the hydrogen environment of 45 MPa have been evaluated. Based thereon, an object of the invention is to provide a high-strength steel having more excellent hydrogen environment embrittlement resistance characteristics than the high yield strength steel plate for welded construction, JIS G 3128 SHY685NS, within the range where the tensile strength in the air is from 900 to 950 MPa.

Means for Solving the Problems

In a constitution of the invention, using a test material based on an ASME S517F steel, detailed studies of tensile properties in a hydrogen atmosphere of 45 MPa have been performed. As a result, there has been found a novel alloy composition having larger values of reduction of area and elongation and smaller susceptibility to hydrogen environment embrittlement in the hydrogen atmosphere of 45 MPa than JIS G 3128 SHY685NS, within the tensile strength range in the air of 900 to 950 MPa as the target strength range, thus leading to the invention.

[1] A high-strength low-alloy steel excellent in high-pressure hydrogen environment embrittlement resistance characteristics, which is characterized in that the steel has a composition comprising C: 0.10 to 0.20%, Si: 0.10 to 0.40%, Mn: 0.50 to 1.20%, Cr: 0.20 to 0.80%, Cu: 0.10 to 0.50%, Mo: 0.10 to 1.00%, V: 0.01 to 0.10%, B: 0.0005 to 0.005% and N: 0.01% or less, by mass, with the balance consisting of Fe and unavoidable impurities.

[2] A method for producing a high-strength low-alloy steel excellent in high-pressure hydrogen environment embrittlement resistance characteristics, which is characterized in that the method comprises a step of melting an alloy steel material having a composition comprising C: 0.10 to 0.20%, Si: 0.10 to 0.40%, Mn: 0.50 to 1.20%, Cr: 0.20 to 0.80%, Cu: 0.10 to 0.50%, Mo: 0.10 to 1.00%, V: 0.01 to 0.10%, B: 0.0005 to 0.005% and N: 0.01% or less, by mass, with the balance consisting of Fe and unavoidable impurities, and a step of performing heat treatment to adjust the tensile strength to 900 to 950 MPa.

[3] The production method described in the above [2], wherein the method comprises a step of performing hot-working and a step of performing normalizing between the melting step and the heat treatment step, and the heat treatment step is a step of performing quenching at 920° C. or more and thereafter performing tempering at a temperature ranging from 600 to 640° C. to adjust the tensile strength in the air to 900 to 950 MPa.

ADVANTAGES OF THE INVENTION

As a main advantage according to the invention, it becomes possible to prepare a high-pressure hydrogen pressure vessel at a lower cost than an austenitic stainless steel. Further, the strength is higher than that of a conventional steel, and susceptibility to hydrogen environment embrittlement is small, so that the design pressure can be increased, or the design thickness can be thinned. Furthermore, as a subordinate advantage, the amount of hydrogen loaded can be increased by an increase in the design pressure. In addition, the production cost of the container can be deceased by a decrease in the thickness of the container.

BEST MODE FOR CARRYING OUT THE INVENTION

Figure 1:
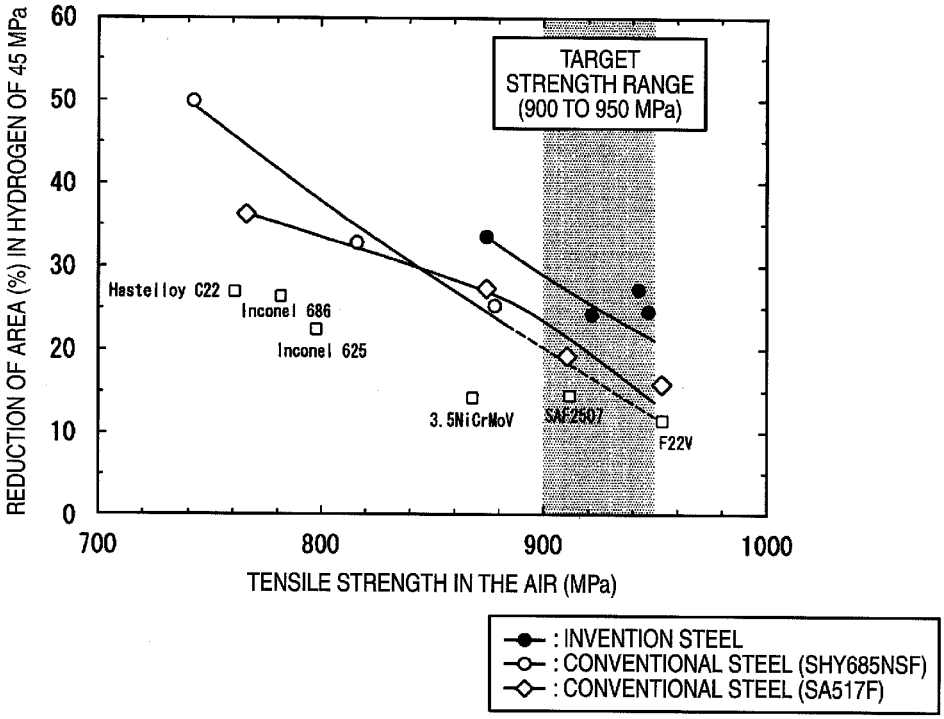
FIG. 1 is a graph showing the relationship between tensile strength in the air and reduction of area in hydrogen of 45 MPa of a steel of the invention and comparative steels.

The limited ranges of the components in the invention will be described below in detail. The following component contents are all represented by mass percentage.

C: 0.10 to 0.20%

C (carbon) is a component effective for improving the strength of the steel, and in order to secure the strength as a steel for welding, the lower limit value thereof is decided as 0.10%. Further, the excessive addition thereof extremely deteriorates weldability of the steel, so that the upper limit value is taken as 0.20%. Desirably, the lower limit is 0.14%, and the upper limit is 0.16%.

Si: 0.10 to 0.40%

Si (silicon) is a component necessary for securing the strength of a base material, deoxidation and the like, and in order to obtain the effects thereof, the lower limit value is taken as 0.10%. However, the excessive addition thereof causes a decrease in toughness of a welded part, so that the upper limit is taken as 0.40%. Desirably, the lower limit is 0.18%, and the upper limit is 0.32%.

Mn: 0.50 to 1.20%

Mn (manganese) is a component effective for strengthening of the steel, and the lower limit thereof is decided as 0.50%. However, the excessive addition thereof causes a decrease in toughness or a crack of a welded part, so that the upper limit is taken as 1.20%. Desirably, the lower limit is 0.80%, and the upper limit is 0.84%.

Cr: 0.20 to 0.80%

Cr (chromium) improves the strength of the steel, but the excessive addition thereof deteriorates weldability. Accordingly, the lower limit is taken as 0.20% and the upper limit as 0.80%. Desirably, the lower limit is 0.47%, and the upper limit is 0.57%.

Cu: 0.10 to 0.50%

Cu (copper) improves the strength of the steel, but the excessive addition thereof increases crack susceptibility at the time of welding. Accordingly, the lower limit is taken as 0.10% and the upper limit as 0.50%. Desirably, the lower limit is 0.31%, and the upper limit is 0.33%.

Mo: 0.10 to 1.00%

Mo (molybdenum) is a component effective for strengthening of the steel, but the excessive addition thereof deteriorates weldability, and causes an increase in cost. Accordingly, the lower limit is taken as 0.10% and the upper limit as 1.00%. Desirably, the lower limit is 0.45%, and the upper limit is 0.55%.

V: 0.01 to 0.10%

V (vanadium) is an element important to secure the strength of the steel, but too much has an adverse effect on toughness. Accordingly, the lower limit is taken as 0.01% and the upper limit as 0.10%. Desirably, the lower limit is 0.04%, and the upper limit is 0.06%.

B: 0.0005 to 0.005%

B (boron) is an element effective for strengthening of the steel and also effective for improvement of hardenability, so that the lower limit value thereof is taken as 0.0005%. On the other hand, the excessive addition thereof causes a reduction in weldability, so that the upper limit value thereof is taken as 0.005%. Desirably, the lower limit is 0.0018%, and the upper limit is 0.0046%.

N: 0.01% or less

When N (nitrogen) exceeds 0.01%, solid solution N increases to cause a decrease in toughness of a welded part. Accordingly, the upper limit value thereof is taken as 0.01%.

Unavoidable Impurity

Ni: less than 0.5%

Ni (nickel) is generally an element effective for improvement of the strength or hardenability of the steel, and is therefore positively added. In the invention, however, Ni causes deterioration of hydrogen environment embrittlement resistance characteristics, so that it is treated as an unavoidable impurity. The upper limit thereof is desirably restricted to less than 0.5%, more desirably to 0.2% or less, and still more desirably to 0.1% or less.

Unavoidable Impurity

P: 0.005% or less

In terms of prevention of deterioration in hot-workability, the less the content of P (phosphorus), the more it is desirable. The content thereof is up to 0.005%.

Unavoidable Impurity

S: 0.005% or less

In terms of preventing deterioration in hot-workability and a decrease in toughness, the less the content of S (sulfur), the more it is desirable. The content thereof is up to 0.005%. It is preferably 0.003% or less, and more preferably 0.001% or less.

One embodiment according to the production method of the invention will be described below.

Alloy steel raw materials adjusted to the composition of the invention are melted to obtain an ingot. A method for melting the alloy steel raw materials is not particularly limited as the invention, and the ingot can be obtained by a conventional method.

The ingot can be subjected to hot-working (hot rolling, hot forging or the like) by a conventional method, and conditions and the like in the hot-working are not particularly limited as the invention.

After the hot-working, suitably, normalizing is performed to a hot-processed material to homogenize a structure. The normalizing can be performed, for example, by heating at 1050 to 1100° C. for 2 hours, followed by furnace cooling.

Further, a quenching-tempering treatment can be performed as heat treatment.

Quenching can be performed by heating, for example, to 920 to 940° C. and rapid cooling. After the quenching, tempering of heating, for example, at 600 to 640° C. can be performed. In the tempering, the tensile strength in the air can be set to 900 to 950 MPa by adjusting the tempering parameter represented by $T(\log t+20)\times10^{-3}$ for the tempering temperature T (K) and time t (hr.) within the range of 18.0 to 18.5, whereby the high-strength low-alloy steel is obtained. The high-strength low-alloy steel shows an excellent reduction of area and excellent elongation characteristics even in a hydrogen atmosphere of 45 MPa.

EXAMPLES

Examples of the invention will be described in detail below.

A material under test was melted in a vacuum induction melting furnace to prepare a 50 kg round ingot, the thickness of which was adjusted to 35 mm by hot forging. A composition of an invention steel material under test is shown in Table 1. In this test, heat treatment was performed at a thickness of 35 mm after hot forging as a production method. The quenching temperature was 920° C., and tempering was performed within the temperature range of 600 to 640° C. The tempering temperature T (K) and time t (h) were adjusted, and the tempering parameter represented by $T(\log t+20)\times10^{-3}$ was varied within the range of 18.3 to 18.6, thereby adjusting the tensile strength in the air to the range of 875 to 950 MPa. After the heat treatment, the test material was processed to a smooth bar tensile test specimen specified in JIS Z 2201, No. 14 (diameter: 8 mm, gauge length: 40 mm). A tensile test in hydrogen was performed under a hydrogen environment of 45 MPa using a high-pressure hydrogen environment fatigue tester. The deformation rate in the tensile test was 0.0015 mm/s, and the test temperature was ordinary temperature. Further, as comparative steels, there were used JIS G 3128 SHY685NS steel and ASME SA517F steel, and other several steels. The comparative steels were produced by known production standards.

The relationship between the tensile strength in the air and the reduction of area in hydrogen of 45 MPa of the materials under test is shown in FIG. 1.

Although the reduction of area in hydrogen of 45 MPa of the invention steel material under test and the comparative steels decreases with an increase in the tensile strength in the air, the invention steel showed a value about 10% larger than that of the comparative steels within 900 to 950 MPa as the target strength range of the materials under test. This shows that the invention steel has a higher strength than the comparative steels and is excellent in susceptibility to hydrogen environment embrittlement.

Figure 2:
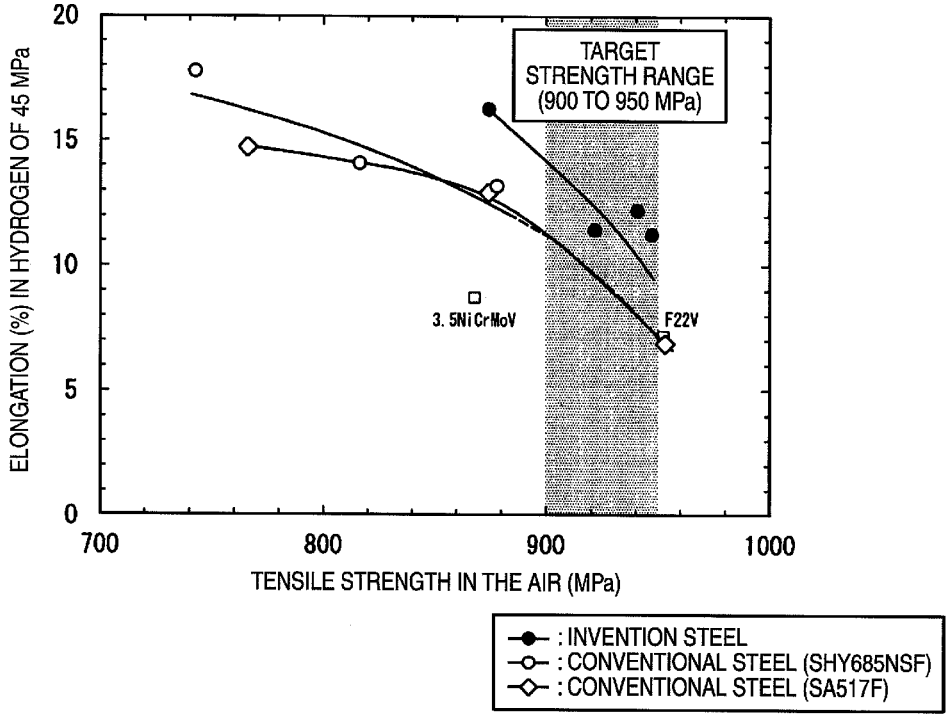
FIG. 2 is a graph showing the relationship between tensile strength in the air and elongation in hydrogen of 45 MPa of a steel of the invention and comparative steels.

The relationship between the tensile strength in the air and the elongation in hydrogen of 45 MPa of the materials under test is shown in FIG. 2. Also in the elongation, the invention steel has a larger value than the comparative steels within the target strength range, and shows low susceptibility to hydrogen environment embrittlement, similarly to the case of the reduction of area. Differences between the material under the invention steel and the comparative steels include a difference in Ni content.

Although the invention has been described in detail with reference to specific embodiments, it will be apparent to those skilled in the art that various changes and modifications can be made without departing from the spirit and scope of the invention. The invention is based on Japanese Patent Application (Application No. 2007-214937) filed on Aug. 21, 2007, the contents of which are herein incorporated by reference.

INDUSTRIAL APPLICABILITY

As a main advantage according to the invention, it becomes possible to prepare a high-pressure hydrogen pressure vessel

TABLE 1

| Kind of Steel | | Composition (% by mass) | | | | | | | | | | |
|---|---|---|---|---|---|---|---|---|---|---|---|---|
| | | C | Si | Mn | P | S | Cr | Mo | Ni | V | B | Cu |
| Invention Steel | | 0.15 | 0.27 | 0.82 | <0.003 | 0.0006 | 0.53 | 0.51 | 0.01 | 0.05 | 0.0022 | 0.32 |
| Conventional Steel | SHY685NSF | 0.1 | 0.23 | 0.97 | 0.006 | 0.0006 | 0.50 | 0.51 | 1.45 | 0.04 | 0.0009 | 0.23 |
| | SA517F | 0.15 | 0.25 | 0.81 | <0.003 | 0.0006 | 0.52 | 0.50 | 0.98 | 0.05 | 0.0025 | 0.31 |
| | SAF2507 | 0.013 | 0.31 | 0.42 | 0.022 | 0.001 | 24.87 | 3.89 | 6.91 | — | — | 0.13 |
| | Inconel 625 | 0.03 | 0.1 | 0.04 | 0.002 | 0.001 | 21.14 | 8.50 | bal. | — | — | 0.01 |
| | Inconel 686 | 0.005 | 0.07 | 0.25 | 0.004 | <0.001 | 20.38 | 16.19 | bal. | — | — | — |
| | Hastelloy C22 | 0.002 | 0.03 | 0.15 | <0.01 | <0.01 | 21.1 | 13.2 | bal. | 0.02 | — | — |
| | F22V | 0.13 | 0.04 | 0.56 | 0.006 | 0.003 | 2.47 | 1.08 | 0.17 | 0.29 | 0.0007 | 0.07 |
| | 3.5NiCrMoV | 0.24 | 0.26 | 0.41 | 0.01 | 0.007 | 1.78 | 0.40 | 3.69 | 0.13 | — | — |

| Kind of Steel | | Composition (% by mass) | | | | | | | | | | |
|---|---|---|---|---|---|---|---|---|---|---|---|---|
| | | Nb | N | Fe | Al | Ti | Co | W | O | Sn | Sb | As |
| Invention Steel | | <0.005 | 0.001 | bal. | — | — | — | — | — | — | — | — |
| Conventional Steel | SHY685NSF | — | — | bal. | — | — | — | — | — | — | — | — |
| | SA517F | <0.005 | 0.0008 | bal. | — | — | — | — | — | — | — | — |
| | SAF2507 | — | 0.264 | bal. | — | — | — | — | — | — | — | — |
| | Inconel 625 | 3.33 (Nb + Ta) | — | 3.12 | 0.22 | 0.24 | 0.02 | — | — | — | — | — |
| | Inconel 686 | — | — | 0.25 | — | 0.17 | 0.01 | 3.92 | — | — | — | — |
| | Hastelloy C22 | — | — | 4.60 | — | — | 1.60 | 2.90 | — | — | — | — |
| | F22V | 0.024 | — | bal. | 0.01 | 0.01 | — | — | — | 0.004 | 0.0012 | — |
| | 3.5NiCrMoV | — | 0.0077 | bal. | <0.005 | — | — | — | 20 (ppm) | 0.022 | 0.0026 | 0.01 |

*Inconel and Hastelloy are trade marks.

at a lower cost than an austenitic stainless steel. Further, the strength is higher than that of a conventional steel, and susceptibility to hydrogen environment embrittlement is small, so that the design pressure can be increased, or the design thickness can be thinned. Furthermore, as a subordinate advantage, the amount of hydrogen loaded can be increased by an increase in the design pressure. In addition, the production cost of the container can be deceased by a decrease in the thickness of the container.

The invention claimed is:

1. A high-strength low-alloy steel excellent in high-pressure hydrogen environment embrittlement resistance characteristics, the high-strength low-alloy steel having a composition consisting of C: 0.10 to 0.20%, Si: 0.10 to 0.40%, Mn: 0.80 to 1.20%, Cr: 0.20 to 0.80%, Cu: 0.10 to 0.50%, Mo: 0.10 to 1.00%, V: 0.01 to 0.06%, B: 0.0005 to 0.005% and N: 0.01% or less, by mass, with the balance consisting of Fe and unavoidable impurities.

2. A method for producing a high-strength low-alloy steel excellent in high-pressure hydrogen environment embrittlement resistance characteristics, the method comprising:

a step of melting and ingot forming an alloy steel material having a composition consisting of C: 0.10 to 0.20%, Si: 0.10 to 0.40%, Mn: 0.50 to 1.20%, Cr: 0.20 to 0.80%, Cu: 0.10 to 0.50%, Mo: 0.10 to 1.00%, V: 0.01 to 0.10%, B: 0.0005 to 0.005% and N: 0.01% or less, by mass, with the balance consisting of Fe and unavoidable impurities; and a step of performing heat treatment to adjust the tensile strength to 900 to 950 MPa.

3. The production method according to claim 2, further comprising:

a step of performing hot-working and a step of performing normalizing between the melting and ingot forming step and the heat treatment step, wherein the heat treatment step is a step of performing quenching after heating at 920° C. or more and thereafter performing tempering at a temperature ranging from 600 to 640° C. in air to adjust tensile strength to 900 to 950 MPa.

4. The production method according to claim 3, wherein the quenching is performed after heating to 920 to 940° C.

* * * * *